US012329227B2

(12) United States Patent
Mazzarolo et al.

(10) Patent No.: US 12,329,227 B2
(45) Date of Patent: Jun. 17, 2025

(54) PROTECTIVE HELMET

(71) Applicant: ALPINESTARS RESEARCH S.P.A., Maser (IT)

(72) Inventors: Giovanni Mazzarolo, Coste di Maser (IT); Roberto Parissenti, Sedico Belluno (IT)

(73) Assignee: ALPINESTARS RESEARCH S.P.A., Maser (IT)

( * ) Notice: Subject to any disclaimer, the term of this patent is extended or adjusted under 35 U.S.C. 154(b) by 37 days.

(21) Appl. No.: 17/617,372

(22) PCT Filed: Jun. 17, 2020

(86) PCT No.: PCT/EP2020/066692
§ 371 (c)(1),
(2) Date: Dec. 8, 2021

(87) PCT Pub. No.: WO2020/254358
PCT Pub. Date: Dec. 24, 2020

(65) Prior Publication Data

US 2022/0248793 A1 Aug. 11, 2022

(30) Foreign Application Priority Data

Jun. 18, 2019 (IT) ..... 102019000009375

(51) Int. Cl.
*A42B 3/06* (2006.01)
*A42B 3/10* (2006.01)
*A42B 3/12* (2006.01)

(52) U.S. Cl.
CPC ..... *A42B 3/064* (2013.01); *A42B 3/10* (2013.01); *A42B 3/127* (2013.01)

(58) Field of Classification Search
CPC ..... A42B 3/064; A42B 3/10; A42B 3/127
See application file for complete search history.

(56) References Cited

U.S. PATENT DOCUMENTS

2009/0222977 A1 9/2009 Arai
2013/0025032 A1 1/2013 Durocher et al.
(Continued)

FOREIGN PATENT DOCUMENTS

EP 2526799 A1 11/2012
WO 0145526 A1 6/2001
WO 2017157765 A1 9/2017

OTHER PUBLICATIONS

PCT International Search Report and Written Opinion dated Aug. 14, 2020 for Intl. App. No. PCT/EP2020/066692, from which the instant application is based, 8 pgs.

*Primary Examiner* — Khoa D Huynh
*Assistant Examiner* — Erick I Lopez
(74) *Attorney, Agent, or Firm* — Fredrikson & Byron, P.A.

(57) ABSTRACT

A protective helmet including an outer shell, an impact absorbing liner positioned inside to the outer shell and shaped so as to correspond to the shape of the wearer's head, and a comfort liner positioned at an inner surface of the impact absorbing liner so as to be in contact with the wearer's head and attached to the outer shell and/or to the impact absorbing liner by means of at least one connecting means. The comfort liner is provided with at least one elastic joint which is positioned in proximity of said at least one connecting means for joining said at least one connecting means to the comfort liner.

11 Claims, 11 Drawing Sheets

(56) References Cited

U.S. PATENT DOCUMENTS

| | | | | |
|---|---|---|---|---|
| 2014/0366252 | A1* | 12/2014 | Mazzarolo | A42B 3/145 2/414 |
| 2016/0113346 | A1* | 4/2016 | Lowe | A42B 3/064 2/412 |
| 2018/0132556 | A1* | 5/2018 | Laperriere | A42B 3/064 |

* cited by examiner

PROTECTIVE HELMET

RELATED APPLICATIONS

This application is a 35 U.S.C. 371 national stage filing from International Application No. PCT/EP2020/066692, filed Jun. 17, 2020, which claims priority to Italian Application No. 102019000009375, filed Jun. 18, 2019, the teachings of which are incorporated herein by reference.

FIELD OF THE INVENTION

The present invention relates to a protective helmet. In particular, the present invention refers, even if in a non-exclusive way, to a protective helmet suitable for being used in motor sports, like motocross.

BACKGROUND

As it is well known in the art, the helmets which are used during sporting activities generally utilize a construction based on three primary components: an outer shell, an impact absorbing liner and a comfort liner.

The outer shell, made of a rigid material, for example a thermoplastic polymer, like polycarbonate or a fiber-reinforced polymer, has the function to protect the head of the helmet's wearer against impacts with the ground or other objects.

The outer shell is also suitable for dissipating, at least partially, in case of an accident, the impact forces acting on the helmet by spreading and transferring them to the second component of the helmet, the impact absorbing liner.

The impact absorbing liner is positioned inside and adjacent to the outer shell and it is dome shaped so as to correspond to the shape of the wearer's head.

The function of the impact absorbing liner is to absorb the impact forces which are generated during an accident, thereby preserving the wearer's head.

Generally, the impact absorbing liner is made of relatively rigid material, like expanded polystyrene.

The third component is the comfort liner which resides on the surface of the impact absorbing liner facing the wearer's head.

The comfort liner is usually made of a combination of soft foam and fabric materials and has the function to make comfortable the helmet, by avoiding that the wearer's head gets in direct contact with the relatively rigid impact absorbing liner.

Nowadays modern protective helmets must be effective in absorbing both radial and oblique impacts.

Radial impacts result only in linear acceleration, while oblique impacts result in linear and rotational acceleration.

Linear acceleration might cause skull fracture, epidural hematoma and translational acceleration of the brain, while rotational acceleration might cause the brain to rotate within the skull. Rotation of the brain might result in injuries, like concussion, diffuse axonal injury (DAT), subdural hematoma, contusion and hematoma intracerebral.

To reduce the rotational energy transmitted to the brain in case of an oblique impact, the various parts of the helmet may be configured to slide relative to each other. This kind of helmet is, for example, disclosed in WO2001/045526, wherein a protective helmet has an outer shell displaceable relative to the inner shell by means of at least one sliding layer arranged between the outer shell and the inner shell. In the edge region of the helmet, the outer shell and the inner shell are interconnected by means of connecting members, for absorbing energy when a displacement of the outer shell on the inner shell occurs. In this way, impact energy from an oblique impact against the helmet may be absorbed during displacement between the outer shell and the inner shell.

At the same time there is the need that the various parts of the helmet remain connected to each other during the normal use.

Connectors suitable for allowing mutual sliding between a first part and a second part of a helmet and for assuring a stable connection between said first part and said second part of the helmet during the normal use are disclosed, for example, in WO2017157765.

This connector comprises: a sliding plate; an anchor point on one side of the plate, configured to be connected to the first part; and a deformable material, configured to at least partially cover the side of the plate on which the anchor point is located; wherein a peripheral region of the deformable material is configured to be connected to the second part and an inner region of the deformable material is connected to at least one of the plate and the anchor point. The connector further comprises a layer of material that is located on the opposite side of the plate from the anchor point; wherein a low friction interface is provided between the opposing surfaces of the plate and the layer of material.

This solution has some drawbacks.

First of all, this solution makes the manufacturing of the helmet more complex and, as consequence, more costly.

The steps for applying the connectors to the liner of the helmet are time consuming.

Moreover, since the connectors, once fastened to the impact absorbing liner, are able to slide relative to the liner of the helmet, the latter might undergo some displacement with respect to the outer shell also during the normal use and not only in case of impact. Such an occurrence might affect the comfort and the stability of the helmet on the wearer's head.

Finally, the connectors disclosed in WO2017157765 may be effective if they are able to freely slide relative to the low friction interface positioned beneath the plate.

However, during the normal use, the connectors are compressed between the deformable material, covering the top portion of the plate, and the low friction interface, covering the bottom portion of the plate, so as to reduce the freedom of movement of the connectors, thereby affecting the possibility that the liner of the helmet might slide, in case of an impact, with respect to the adjacent parts of the helmet.

BRIEF SUMMARIES OF OBJECTS OF THE INVENTION

The object of the present invention is to provide a protective helmet which solves at least partly the above mentioned problems and drawbacks.

In particular, an aim of the present invention is to provide a protective helmet having a comfort liner which is firmly affixed to the outer shell or to the impact absorbing liner of the helmet during normal use and suitable for being displaced with respect to the outer shell or to the impact absorbing liner during an impact, so as to reduce rotational accelerations acting on the wearer's head.

Moreover, an aim of the present invention is to provide a protective helmet having a comfort liner which can be easily attached to and detached from the outer shell or to/from the impact absorbing liner without affecting its functionality.

Furthermore, an aim of the present invention is to provide a protective helmet which can offer an improved protection against radial and oblique impacts.

Finally an aim of the present invention is to provide a protective helmet which can be manufactured at competitive costs.

These and other objects and aims are achieved by the protective helmet according to claim 1.

BRIEF DESCRIPTIONS OF THE DRAWINGS

The advantages and the characteristic features of the invention will appear more clearly from the following description of a preferred, but not exclusive, embodiment of the protective helmet with reference to the accompanying figures in which.

Figure 2:
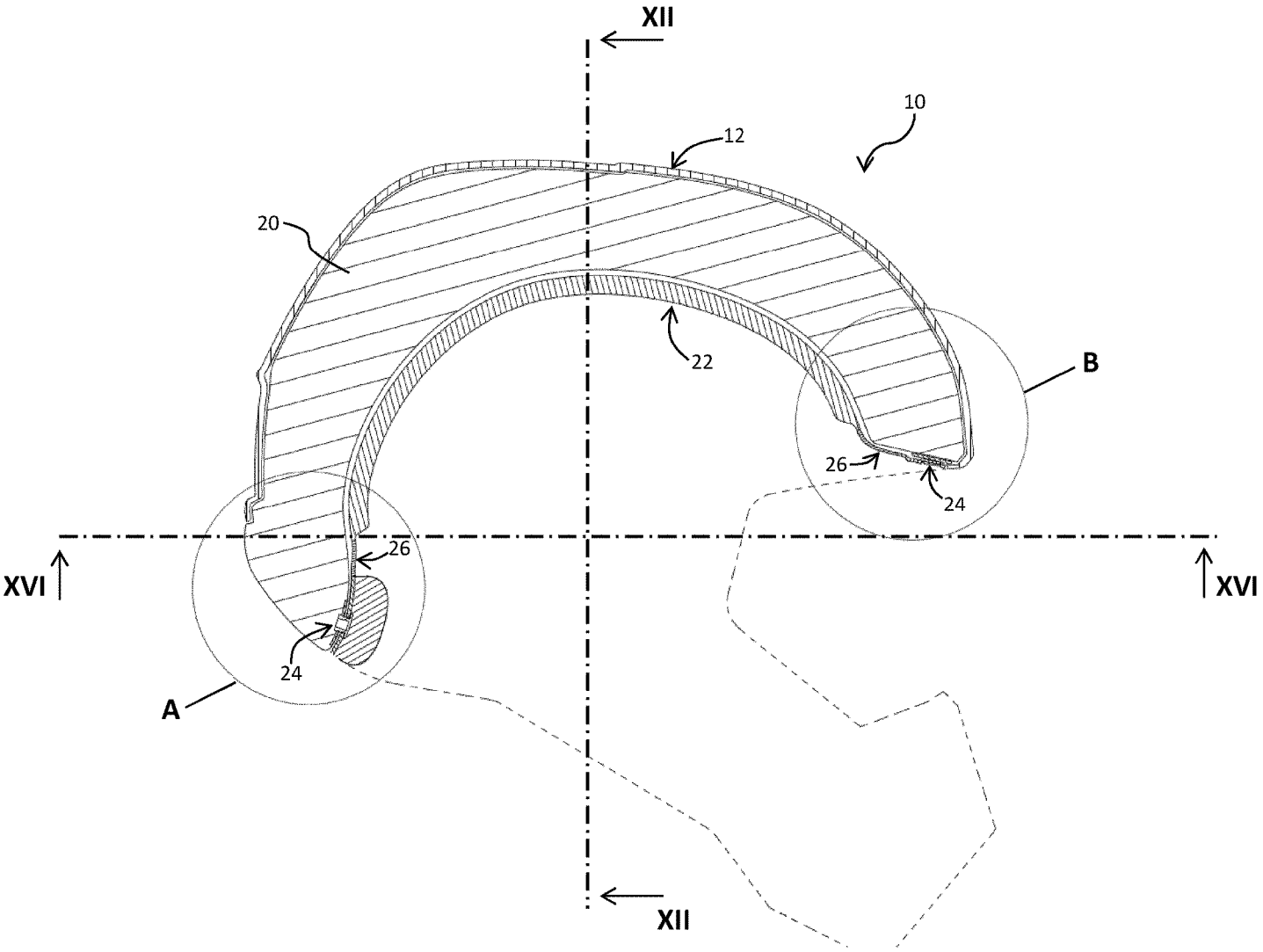
FIG. 2 shows a schematic cross section of the protective helmet of FIG. 1, wherein the visor has been removed for sake of clarity.
Figure 13:
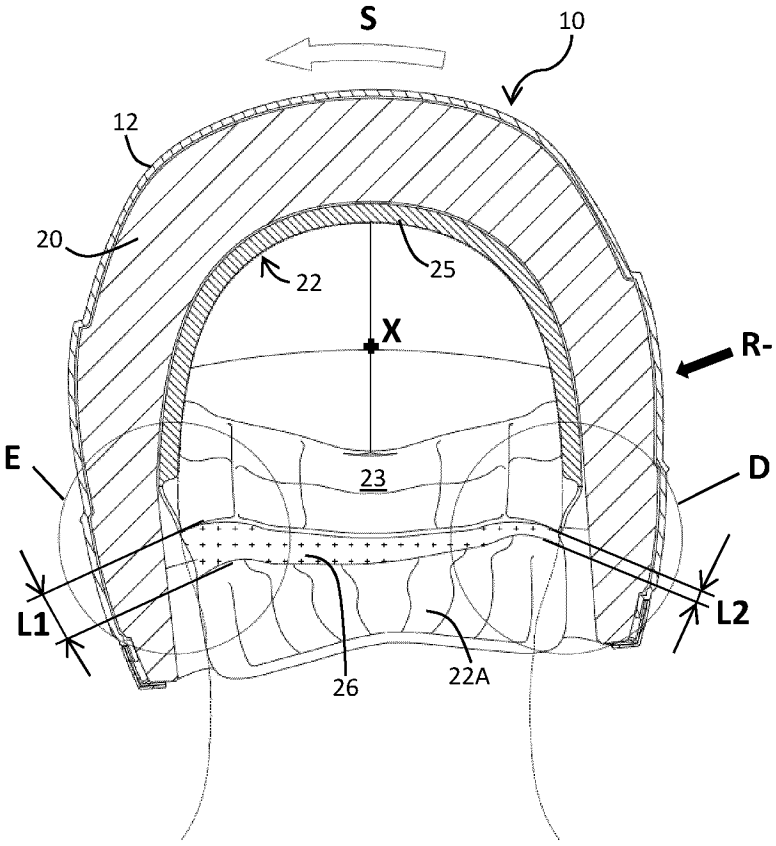
Figure 12:
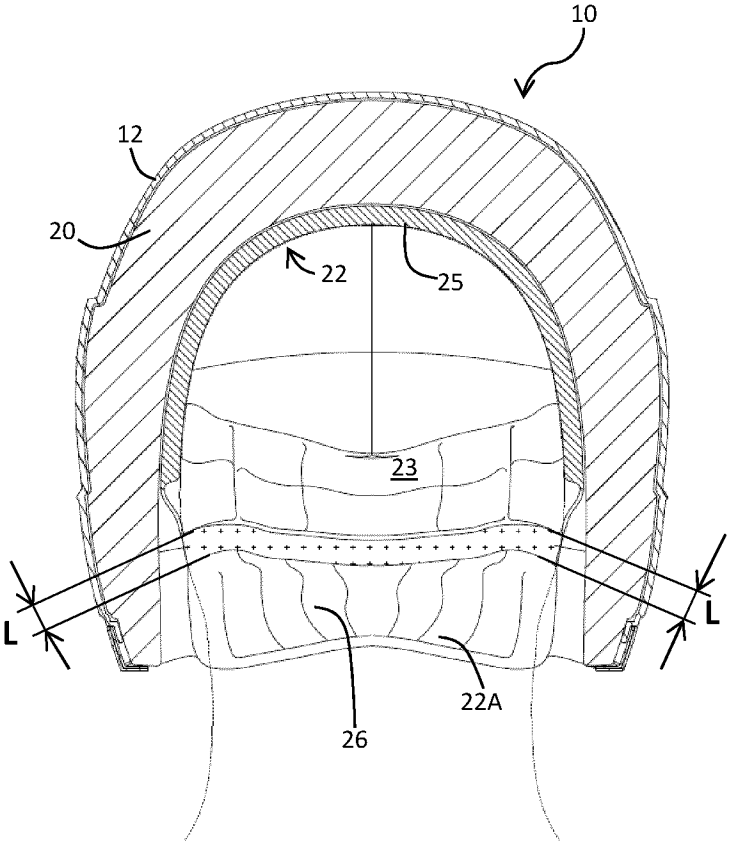
Figure 15:
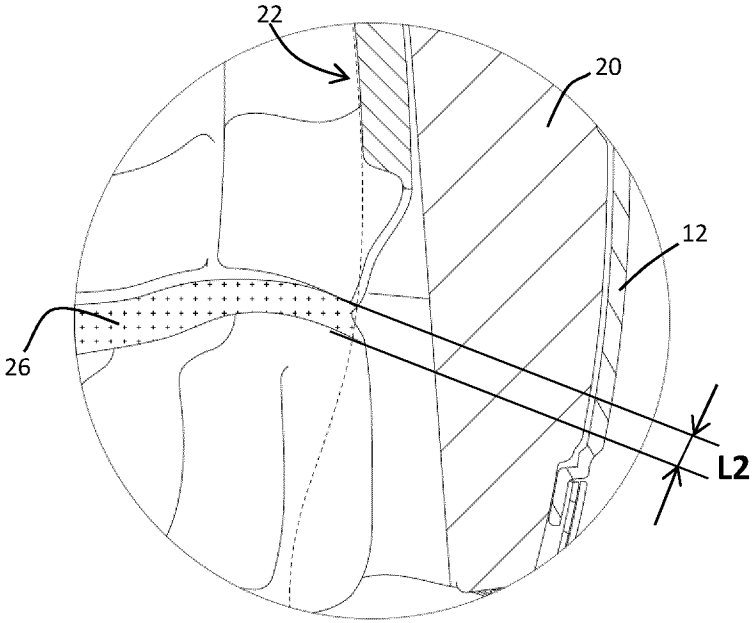
Figure 14:
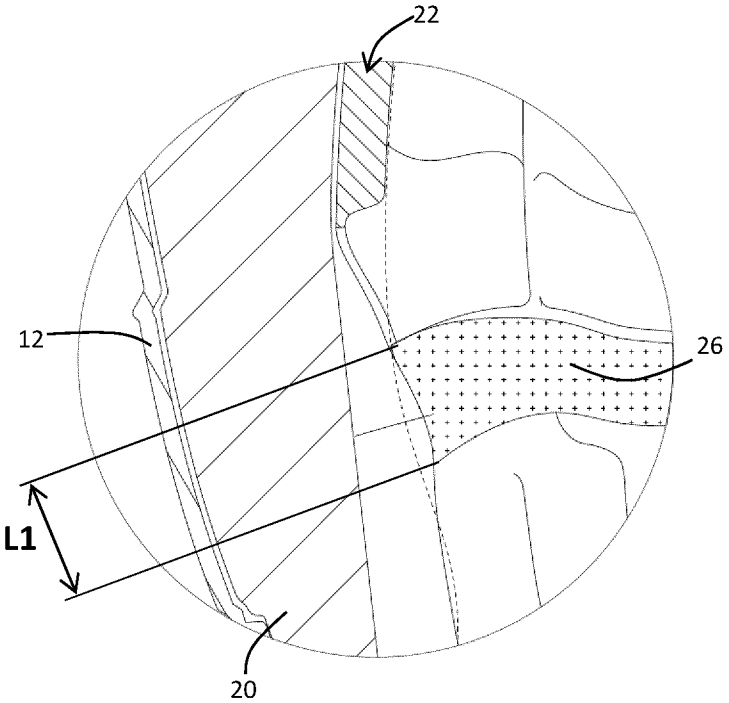
Figure 17:
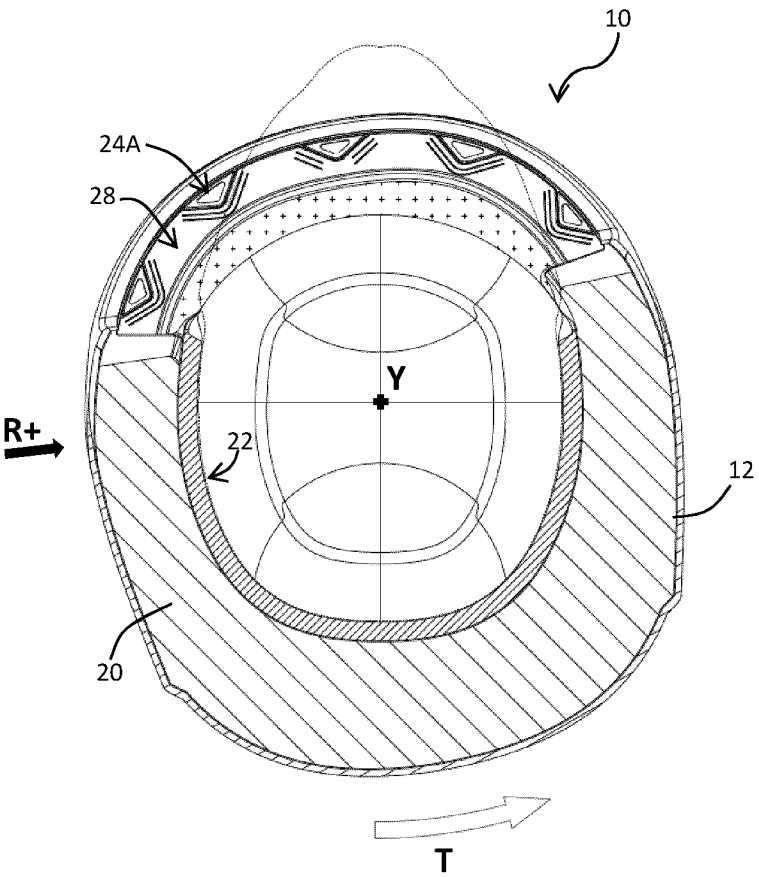
Figure 16:
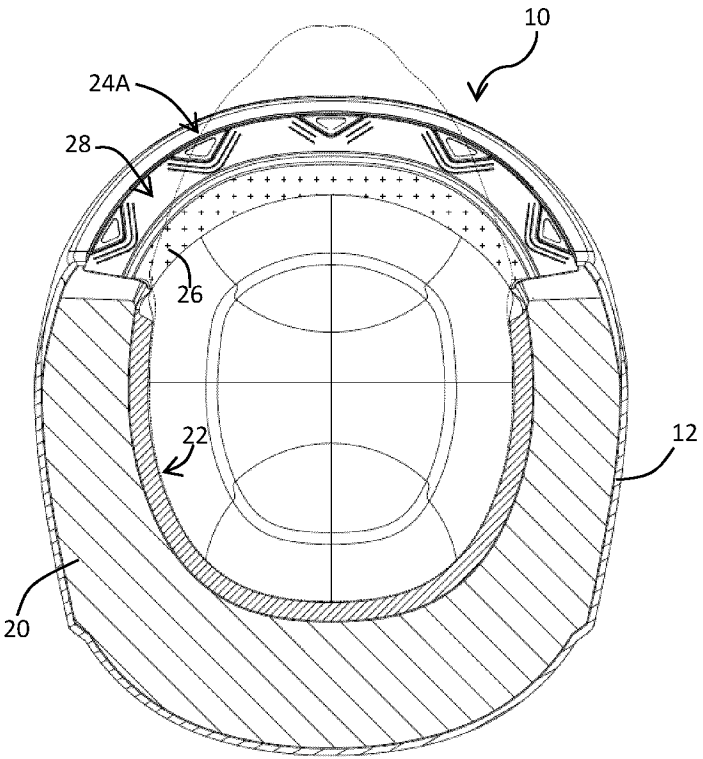

FIG. 12 schematically shown a cross section view taken along the line XII-XII of FIG. 2;

FIG. 13 is a view similar to FIG. 12, wherein a sideward rotation of the protective helmet, with respect to the user's head, is schematically shown;

FIGS. 14 and 15 are, respectively, enlarged views of the details E and D of FIG. 13;

FIG. 16 schematically shown a cross section view taken along the line XVI-XVI of FIG. 2;

FIG. 17 is a view similar to FIG. 16, wherein a sideward rotation of the protective helmet, with respect to the user's head, is schematically shown.

DETAILED DESCRIPTION OF EMBODIMENTS OF THE INVENTION

With reference to the attached figures, an example of a protective helmet according to the invention is indicated as a whole by the reference 10. Said protective helmet 10 is suitable for being used by motorcyclists, in particular by motocross riders. Nevertheless, as it will appear more clearly from the following description, the protective helmet 10 can also be advantageously used by cyclists, skiers and hockey, football, polo or other sports players where an effective protection of the user's head must be obtained.

Figure 1:
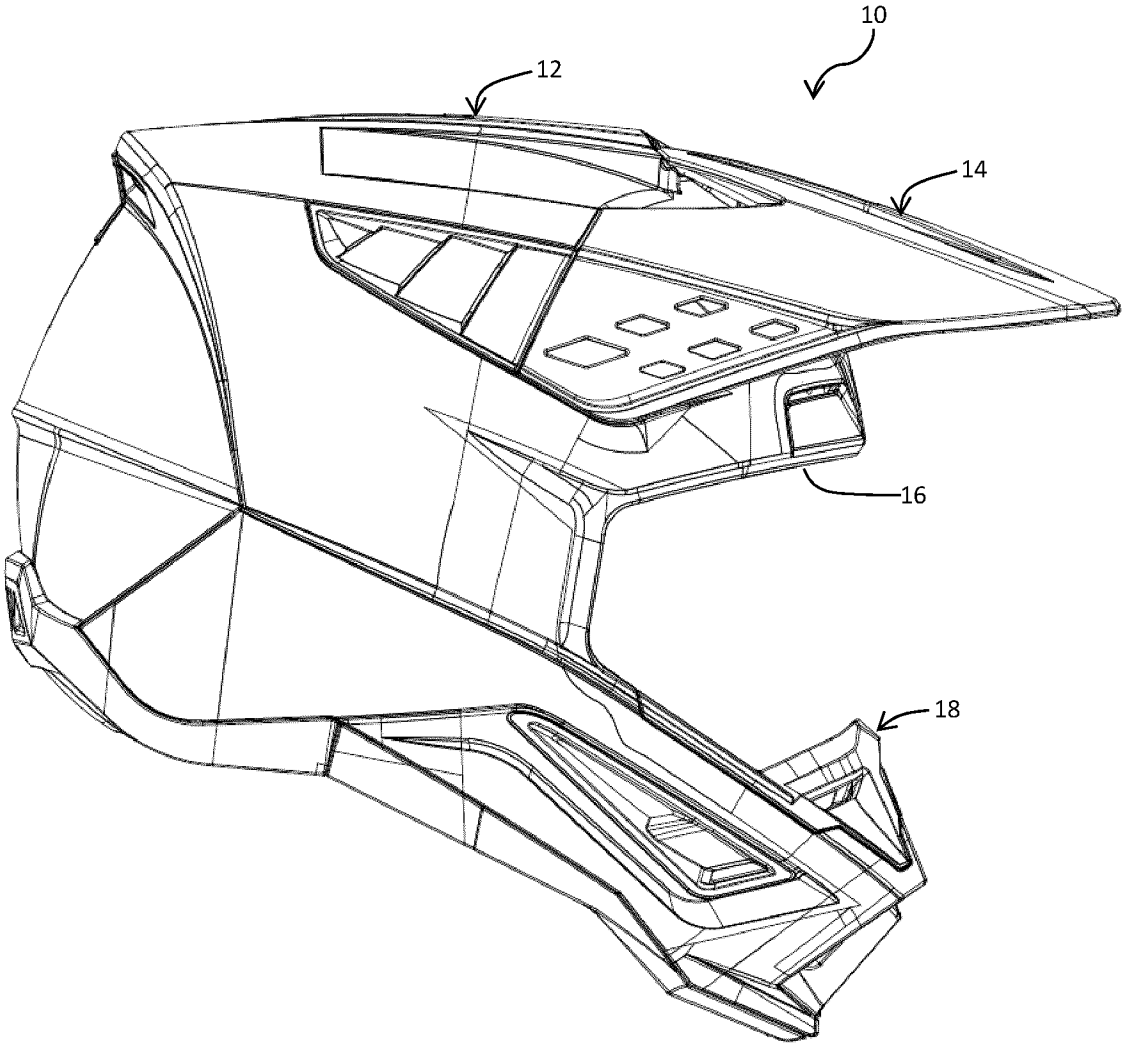
FIG. 1 shows a side view of a protective helmet according to the present invention.

As shown in FIG. 1, the protective helmet 10 comprises an outer shell 12, which is preferably made of rigid material, for example thermoplastic polymer, like polycarbonate or a fiber-reinforced polymer. The outer shell 12 is dome shaped so as to fit over the user's head.

The helmet might also comprise a visor 14, made preferably of rigid material, which is generally designed to be removably coupled to the outer shell 12. The visor 14 may be coupled to the outer shell 12 so as to project above a front opening 16 of the outer shell 12.

In FIG. 1, a protective helmet 10 provided with a chin guard 18 is shown. However, the teachings of the present invention may also be advantageously applied to the so-called "jet helmets".

As shown in FIG. 2, the protective helmet 10 also comprises an impact absorbing liner 20 and a comfort liner 22, both arranged inside the outer shell 12.

The impact absorbing liner 20 is positioned adjacent to the outer shell 12 and it is shaped so as to correspond to the shape of the wearer's head. The impact absorbing liner 20 is designed to absorb the energy of impact and it can be made of foam material, like for example expanded polystyrene (EPS) or expanded polypropylene (EPP).

The comfort liner 22 is positioned at the inner surface of the impact absorbing liner 20, so as to be in contact with the wearer's head, during the use of the helmet 10.

The comfort liner 22 can be made with synthetic foam, for example polyurethane foam pad, covered with a skin-friendly fabric.

The comfort liner 22 is attached to the outer shell 12 and/or to the impact absorbing liner 20 by means of at least one connecting means 24.

Preferably, in order to be cleaned or to be changed with a new one if needed, the comfort liner 22 is removably attached to the outer shell 12 and/or to the impact absorbing liner 20.

According to the embodiment of FIG. 2, the comfort liner 22 is removably attached to the impact absorbing liner 20. However, in different embodiments, not shown in the attached figures, the comfort liner may be attached to the outer shell 12 or may be attached both to the outer shell 12 and to the impact absorbing liner 20. For example, a first portion of the comfort liner 22 may be attached to the outer shell 12 and a second portion of the comfort liner 22 may be attached to the impact absorbing liner 20.

If not differently specified, in the following reference will be made to the embodiment of FIG. 2, wherein the comfort liner 22 is removably attached to the impact absorbing liner 20. Nonetheless the same notes are also valid for the other above mentioned embodiments.

According to the invention, the comfort liner 22 is provided with at least one elastic joint 26 which is positioned in proximity of a connecting means 24 for joining said at least one connecting means 24 to the comfort liner 22.

In the present specification, the term "elastic" is intended to refer to a material having the property of returning to its original configuration after deformation. In particular, an elastic joint is a joint which, upon application of an elongating force, is able to be stretched, at least partially, to a biased length which is greater than its original unbiased length, and which will be able to return to its original length upon release of the elongating force.

At the same time an elastic joint may be a joint which, upon application of a compressing force, is able to be contracted, at least partially, to a compressed length which is smaller than its original unbiased length, and which will be able to return to its original length upon release of the compressing force.

As it will be explained in detail hereinafter, the provision of the elastic joint 26 significantly improves the absorption of rotational acceleration acting on the helmet 10 in case of an oblique impact, reducing the potential risk of injury for the wearer. As a matter of fact, the positioning of the elastic joint 26 between the outer shell 12 or the impact absorbing liner 20 and the comfort liner 22 allows a mutual displacement, in case of an oblique impact, between the outer shell 12 and the comfort liner 22. Since the comfort liner 22 in use is substantially integral with the wearer's head, the rotational energy transmitted to the brain caused by oblique impacts is thus reduced. At the same time, the joint 26 being elastic is also able to dampen such a rotational energy.

Moreover, the elastic joint 26 does not affect the fixing of the comfort liner 22 to the outer shell 12 or to the impact absorbing liner 20, allowing the proper fit of the helmet 10 over the user head during normal use. In this way, accidental movements of the helmet 10 on the wearer's head are avoided.

Consequently, the provision of the elastic joint 26 allows the comfort liner 22 to stay in the proper position during normal use, while allowing it to displace with respect to the outer shell 12 or to the impact absorbing liner 20 in case of an oblique impact.

The elastic joint 26 can be a woven or non-woven fabric. A number of different materials can be used for the elastic joint 26, for example polyamide, polyurethane or a mixing of polyamide and polyurethane.

Alternatively, the elastic joint 26 can be a spring, made with a metallic or polymeric material.

The elastic joint 26 can also be made with elastic rubber tapes. In addition, the elastic joint 26 can also be made by using a technique which is well-known in the field of garment for motorcyclists, namely by superimposing and joining a layer of thin elastic fabric to a layer of leather. A series of closely arranged transverse stitches are performed when the layer of elastic fabric is fully tensioned with the result that a plurality of folds are created when the suit is in rest condition. The inserts so obtained are identified in the technical jargon as "accordion leather stretch inserts".

The elastic joint 26 can be made with a layer of elastic material having a thickness from 0.1 mm to 1.2 mm, but other thickness values can be used depending on the selected material.

Figure 3:
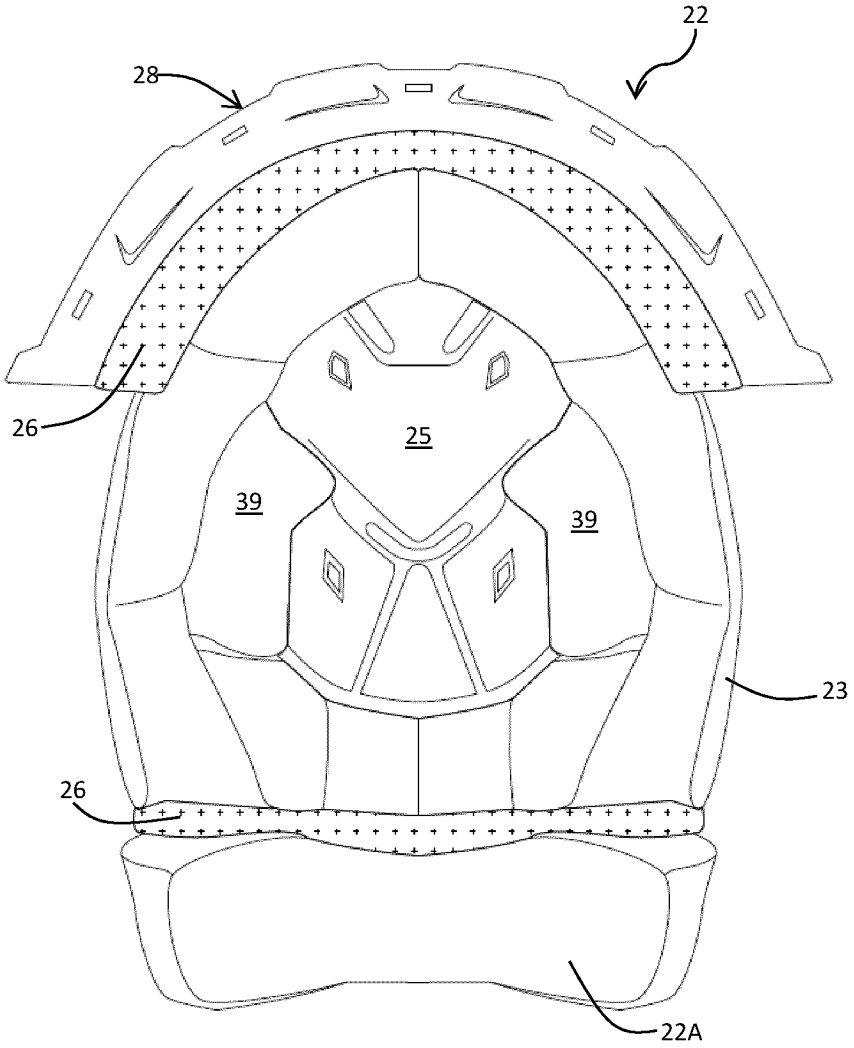
FIG. 3 shows a bottom view of the comfort liner of the protective helmet of FIG. 1.
Figure 4:
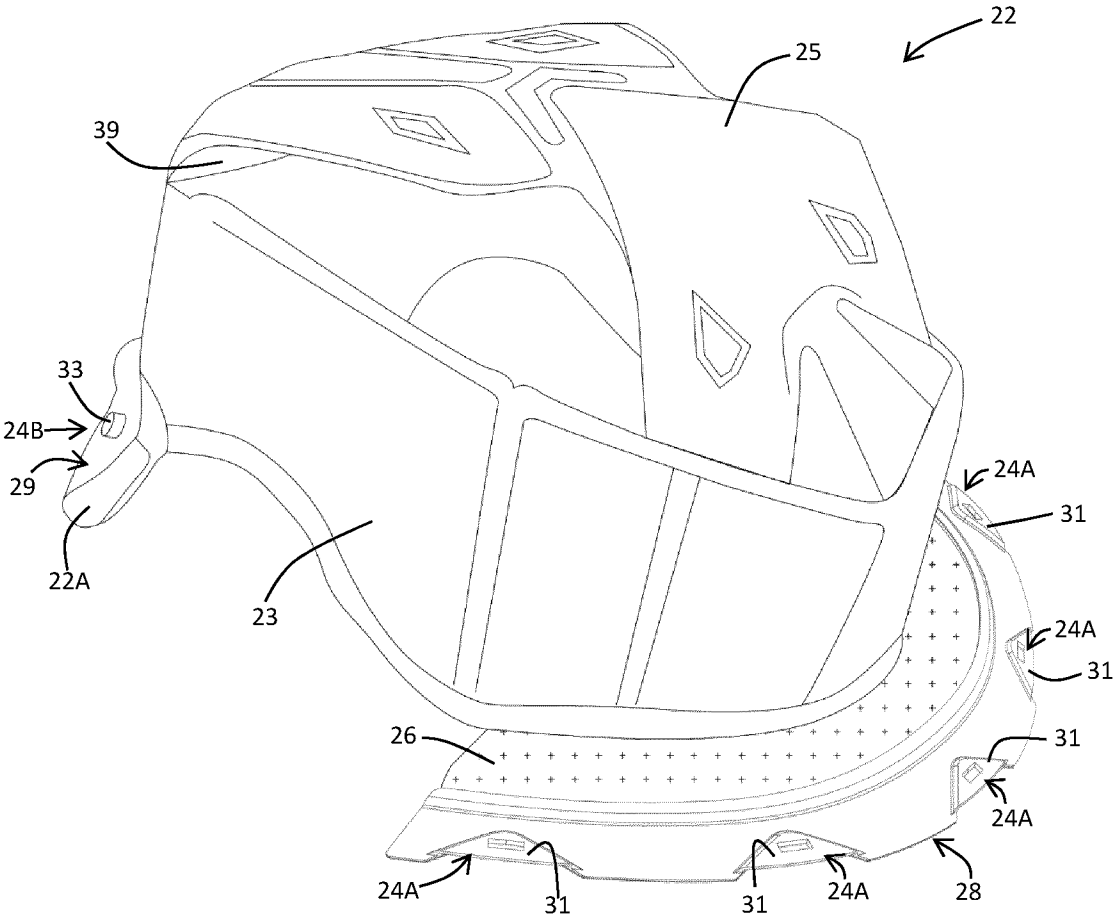
FIGS. 4 and 5 are, respectively, a front and a rear perspective view of the comfort liner of FIG. 3.
Figure 5:
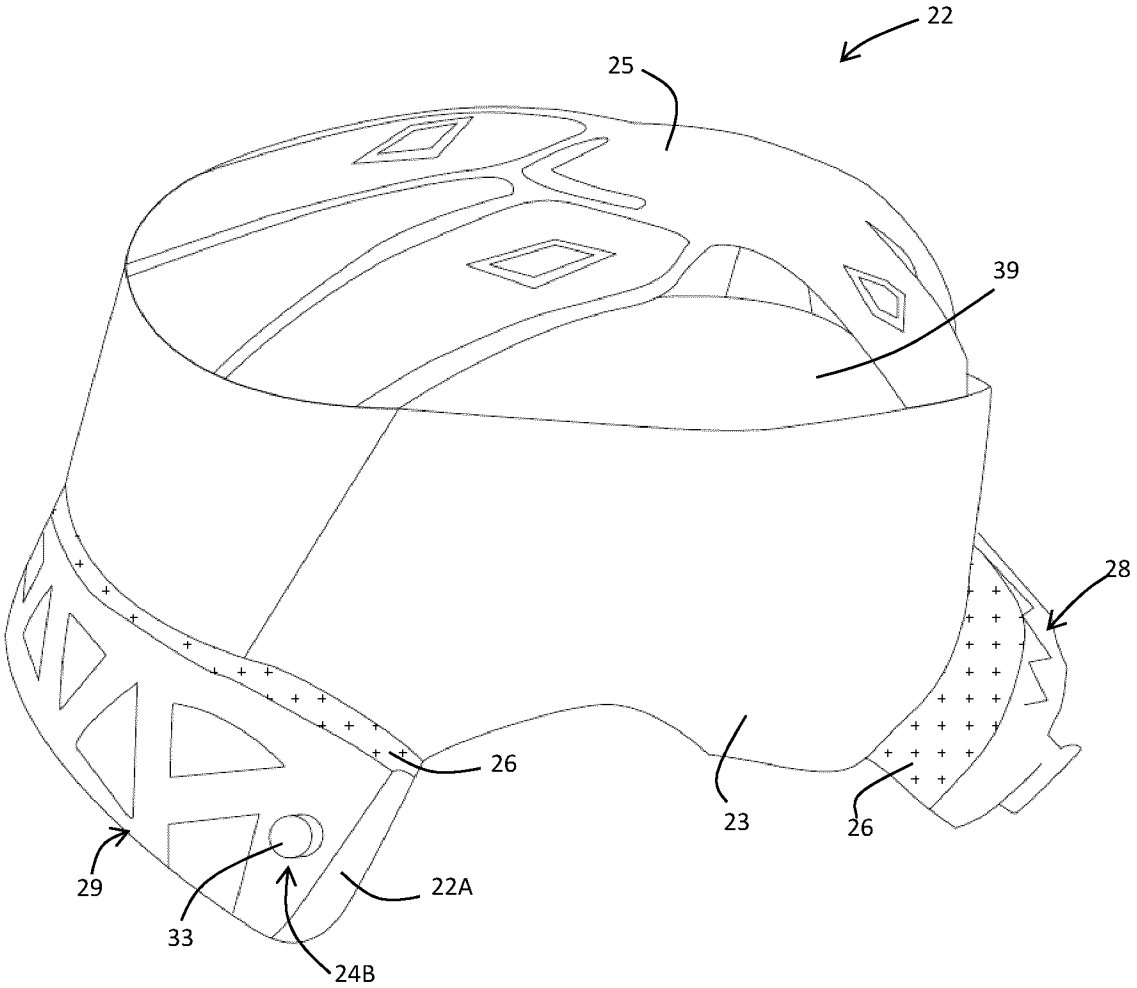

As shown in FIGS. 3-5, the comfort liner 22 is dome shaped so as to fit over the user's head. The comfort liner 22 may comprise a crown pad 23, designed to encompass the side parts of the user's head, and a top pad 25, designed to be positioned on top of the user's head.

Crown pad 23 and top pad 25 may be made of a single piece or alternatively they may consist of a number of component parts connected by means of ties. Suitable openings 39 may be provided in the crown pad 23 and/or in the top pad 25 to favor the ventilation of the user's head.

According to the embodiments shown in the attached figures, the elastic joint 26 may be positioned at the bottom portion of the comfort liner 22.

In particular, the elastic joint may be positioned at the bottom portion of the crown pad 23. According to the embodiment of FIGS. 3-5, the elastic joint 26 may be positioned at the front bottom portion and/or at rear bottom portion of the crown pad 23. The front portion of the crown pad is the portion of the crown pad 23 closer to the front of the user and the rear portion of the crown pad 23 is the portion of the crown pad closer to the neck of the user.

As shown in the attached figures, the elastic joint 26 may be a strip of elastic material running along the bottom portion of the comfort liner 22 so as to form an appendix.

In a different embodiment, the elastic joint 26 may consist in one or more elastic bands extending from the bottom edge of the comfort liner 22.

However different embodiments are possible since, in order to be effective, it is only requested that the elastic joint 26 is interposed between the connecting means 24 and a peripheral portion of the comfort liner 22.

The connecting means 24 may be directly or indirectly connected to the elastic joint 26.

In the first case, not shown in the attached figures, the connecting means 24 may be directly applied on the elastic joint 26.

In the second case, the comfort liner 22 may comprise a supporting flap 28, 29 connected to the elastic joint 26 and the connecting means 24 are provided on this supporting flap 28, 29. Advantageously, the supporting flap 28, 29 may be made with a rigid or semi-rigid material. For example, the supporting flap 28, 29 may be made with a thermoplastic polymer material, like for example polypropylene (PP), acrylonitrile butadiene styrene (ABS) or polyamide (PA). As shown in FIGS. 3-5, the comfort liner 22 may be provided with a front supporting flap 28 and a rear supporting flap 29 on which front connecting means 24A and rear connecting means 24B are respectively provided.

Preferably, the front supporting flap 28 is shaped so as to fit with the shape of the front bottom edge of the impact absorbing liner 20. Similarly, the rear supporting flap 29 is shaped so as to fit with the shape of the rear lower portion of the impact absorbing liner 22, namely the portion of the impact absorbing liner 20 facing the nape of the wearer.

Figure 6:
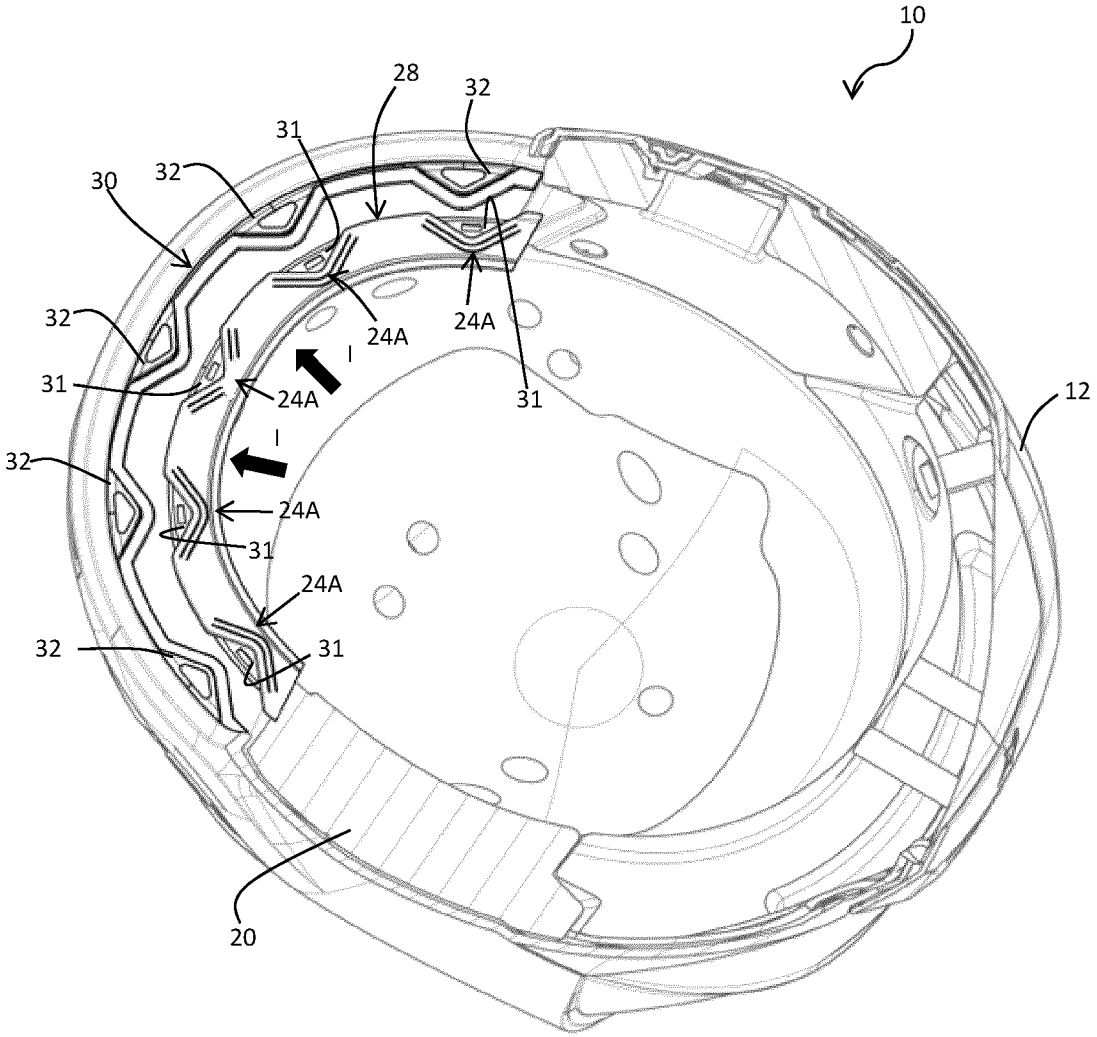
FIG. 6 shows schematically how the front portion of the comfort liner of FIG. 3 might be attached to the impact absorbing liner of the protective helmet of FIG. 1.
Figure 8:
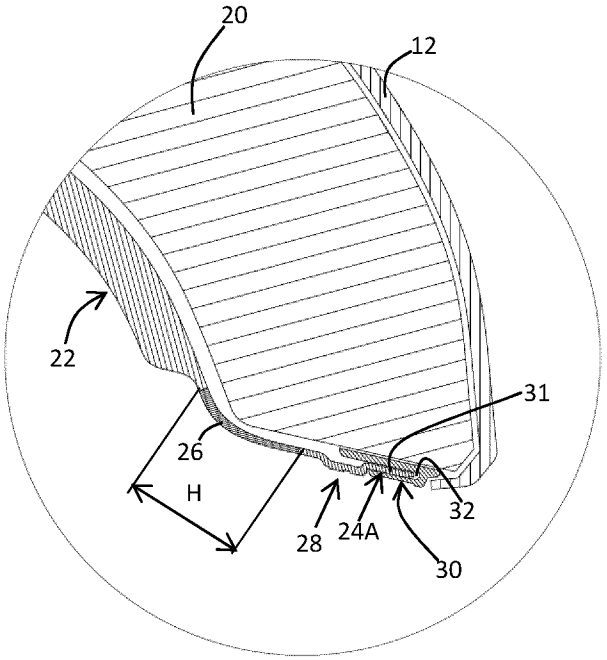
FIGS. 7 and 8 are, respectively, enlarged views of the details A and B of FIG. 2.

With reference to FIGS. 6 and 8, the front supporting flap 28 may be designed to be inserted inside a slit 30 provided at the bottom edge of the impact absorbing liner 20. In FIG. 6 it is schematically shown how the front supporting flap 28 may be inserted inside the slit 30. The insertion direction is indicated by the arrows I.

The front connecting means 24A are preferably provided on the surface of the front supporting flap 28 designed to be faced with the bottom edge of the impact absorbing liner 20.

The front connecting means 24A may consist of projections 31 shaped to engage with corresponding cavities 32 provided on the slit 30, so that the coupling between the comfort liner 22 and the impact absorbing liner 20 is obtained by means of a shape coupling between the projections 31 of the front connecting means 24A and the cavities 32 of the slit 30.

The projections 31 and the cavities 32 may be designed for realizing a snap-fit connection.

The provision of the front supporting flap 28 allows an easy attachment of the front portion of the comfort liner to the impact absorbing liner, since by means of a single act it is possible to simultaneously couple all the front connecting means 24A to the bottom edge of the impact absorbing liner.

At the same time, the front supporting flap 28 being designed to fit with the bottom edge of the impact absorbing liner allows the front portion of the comfort liner to stay close to the impact absorbing liner assuring a high comfort to the user and an improved stability of the helmet over the user's head.

The rear supporting flap 29 in turn is designed to abut against the rear lower portion of the impact absorbing liner 22. The rear connecting means 24B may be provided on the surface of the rear supporting flap 29 facing the impact absorbing liner 20. The opposite surface of the rear supporting flap 29, namely the surface facing the user's nape, may be covered by a cushioning pad 22A (see FIGS. 3-5 and 7).

The rear connecting means 24B may consist of a pin 33 designed to be inserted inside a corresponding seat 34 provided on the impact absorbing liner 20.

Alternatively, the rear connecting means 24B may consist of a seat designed to be engaged by a corresponding projection provided on the impact absorbing liner 20.

The provision of the rear supporting flap 29 allows an easy attachment of the rear portion of the comfort liner to the impact absorbing liner.

At the same time, the rear supporting flap 29 being designed to fit with the rear part of the impact absorbing liner allows the rear portion of the comfort liner to stay close to the impact absorbing liner assuring a high comfort to the user and an improved stability of the helmet over the user's head.

Hereafter the behaviour of the protective helmet 10 in case of an impact will be described by specifically referring to FIGS. 9-17.

These figures refer to the embodiment of the comfort liner 22 with two elastic joints 26 provided at front part of the comfort liner and at rear part of the comfort liner respectively. The elastic joints 26 are in the form of a strip connecting a front supporting flap 28 and a rear supporting flap 29 to the comfort liner 22. Front connecting means 24A and rear connecting means 24B are provided on the front supporting flap 28 and on the rear supporting flap 29.

However, the same comments are also valid for the other embodiments above disclosed.

In case of an impact at the front part of the protective helmet (see arrow P− in FIG. 9), the elastic joints 26 allow a mutual rotation of the outer shell 12 with respect to the user's head. Such a mutual rotation takes place around the Z axis of FIG. 9 and it substantially consists in a backward rotation of the helmet over the users' head (the backward rotation is indicated by the arrow K).

Figure 7:
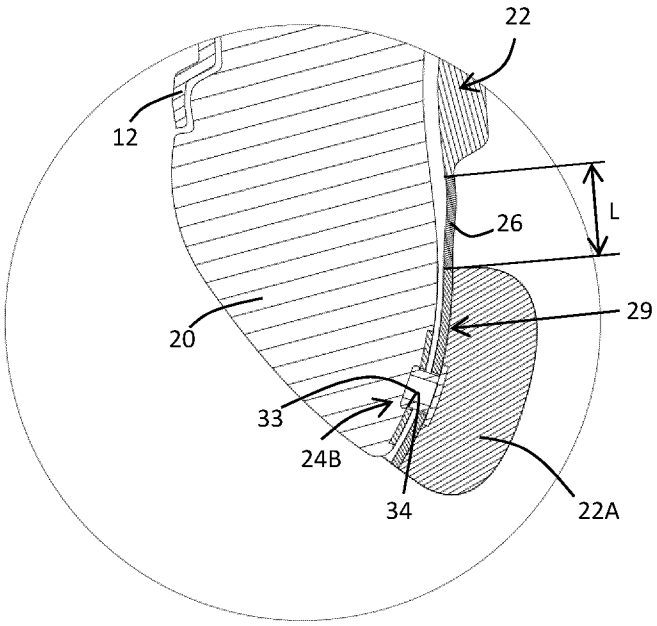
Figure 10:
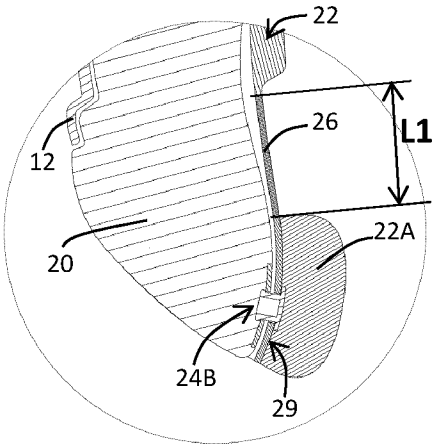
FIGS. 10 and 11 are, respectively, enlarged views of the details A1 and B1 of FIG. 9.
Figure 11:
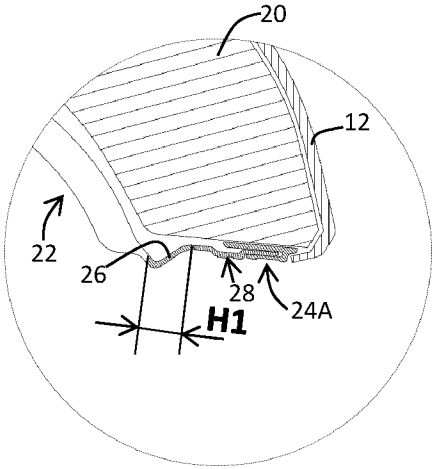
Figure 9:
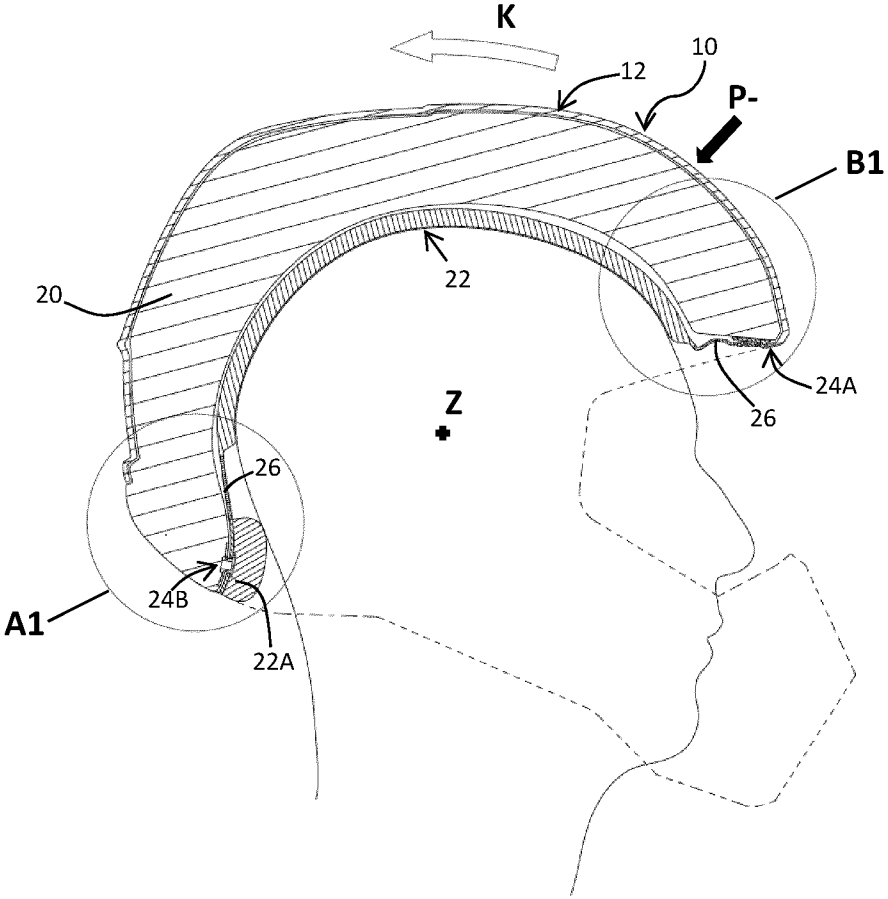
FIG. 9 is a view similar to FIG. 2, wherein a backward rotation of the protective helmet, with respect to the user's head, is schematically shown.

As it is schematically shown in FIGS. 10 and 11, the mutual rotation K between the impact absorbing liner 20, which is integral with the outer shell 12, and the comfort liner 22, which is in contact with the user's head, causes the stretching of the rear elastic joint 26 which will assume a length L1 greater than the original length L of the joint when it is in its neutral configuration (see FIG. 7).

At the same time, the mutual rotation K causes the compression of the front elastic joint 26 which will assume a length H1 shorter than the original length H (see FIG. 8).

The elongation and the compression of the elastic joints 26, respectively provided at the rear part and at the front part of the comfort liner, permit a controlled displacement of the user's head with respect to the outer shell so as to reduce the rotational accelerations acting on the user's head and, indirectly, on the user's brain.

Also in case of an impact at the left part of the protective helmet (see arrow R− in FIG. 13), the elastic joints 26 allow a mutual rotation of the outer shell 12 with respect to the user's head. Such a mutual rotation takes place around the X axis of FIG. 13 and it substantially consists in a sideward rotation of the helmet over the user's head (the sideward rotation is indicated by the arrow S).

As it is schematically shown in FIGS. 12 and 13, the mutual rotation S between the impact absorbing liner 20, which is integral with the outer shell 12, and the comfort liner 22, which is in contact with the user's head, causes the stretching of the portion of the rear elastic joint 26 proximate to the right side of the helmet. Said portion of the elastic joint 26 will assume a length L1 greater than the original length L, (see FIGS. 12, 13 and 14). In this case, the stretching of this portion of the elastic joint 26 is not uniform. As a matter of fact, the stretching of this portion of the rear elastic joint 26 decreases as the distance from the right side of the outer shell increases.

At the same time, the mutual rotation S causes the compression of the portion of the rear elastic joint 26 proximate to the left side of the helmet. Said portion of the elastic joint 26 will assume a length L2 shorter than the original length L (see FIG. 15).

Also in this case, the compression of this portion of the rear elastic joint 26 is not uniform. As a matter of fact, the compression of this portion of the rear elastic joint 26 decreases as the distance from the outer shell increases.

The front elastic joint 26 in case of a side impact has a behaviour similar to that of the rear elastic joint above disclosed.

Therefore, also in this case, the elastic joints 26 are effective in allowing a controlled displacement of the user's head with respect to the outer shell so as to reduce the rotational accelerations acting on the user's head and, indirectly, on the user's brain.

With reference to FIGS. 16 and 17, the elastic joints 26 are also effective in case of an impact R+ acting on the right part of the helmet and causing a mutual rotation of the outer shell 12 with respect to the user's head around the Y axis of FIG. 17. Such a rotation is indicated by the arrow T in FIG. 17.

In this case, the mutual rotation T between the impact absorbing liner 20, which is integral with the outer shell 12, and the comfort liner 22, which is in contact with the user's head, causes the compression of the portion of the front elastic joint 26 proximate to the right side of the helmet. Such a compression is not uniform since it decreases as the distance from the right side of the outer shell increases.

At the same time, the mutual rotation T causes the stretching of the portion of the front elastic joint 26 proximate to the left side of the helmet. Such a stretching is not uniform since it decreases as the distance from the right side of the outer shell increases.

The rear elastic joint 26 in case of a mutual rotation T between the outer shell and the comfort liner has a behaviour similar to that of the front elastic joint above disclosed.

Also in this case, thus, the stretching and the compression of the elastic joints 26 permits the user's head to rotate in a controlled way with respect to the outer shell so as to reduce the rotational accelerations acting on the user's head and, indirectly, on the user's brain.

Hereinafter a comparison table is provided reporting the values of the peak linear acceleration (PLA) and the peak rotational acceleration (PRA) measured for different impact points on a helmet comprising a comfort liner which is not provided with the elastic joint 26 above disclosed (hereinafter called stiff configuration) and on a helmet comprising a comfort liner with front and rear elastic joints 26 (hereinafter called elastic configuration).

The materials used for the elastic configuration and for the stiff configuration are elastam (specifically Lycra®) and a generic fabric respectively.

A tensile test according to ISO 13594-1 was performed to characterize the above mentioned materials.

The tensile modulus of the elastam is about 0.12 N/mm, while the tensile modulus of the generic fabric is about 7.5 N/mm.

| | PLA (g) | | | PRA (rad/s$^2$) | | |
|---|---|---|---|---|---|---|
| | stiff | elastic | diff. % | stiff | elastic | diff. % |
| P+ | 134.8 | 139.8 | 3.71 | 4603 | 3535 | −23.19 |
| R+ | 160.5 | 155.6 | −3.05 | 7017 | 4461 | −36.42 |
| P− | 142.1 | 146 | 2.79 | 7219 | 6233 | −13.65 |

In the above table, the references P+, R+, P−, identify the different impact points on the helmet, in particular:

P+ identifies an impact on the rear part of the helmet;

R+ identifies an impact on the right part of the helmet;

P− identifies an impact on the front part of the helmet.

From the table it can be observed that the elastic joints do not affect substantially the linear absorption (PLA).

At the same time the peak values of rotational acceleration of the helmet having the elastic configuration are considerably reduced with respect to the values of rotational acceleration of the helmet having the stiff configuration.

Obviously the elastam is only one of the various elastic materials which can be used for the elastic joint 26.

At this point it is clear how the predefined objects are achieved with the protective helmet 10 according to the invention.

As a matter of fact, the insertion of the elastic joint 26 allows to reduce the rotational acceleration caused by oblique impacts.

At the same time, the elastic joint 26 does not affect the connection of the comfort liner to the impact absorbing liner during the normal use of the helmet.

Moreover, the provision of the elastic joint 26 does not make the comfort liner bulky and it does not hinder the connection of the comfort liner to the impact absorbing liner.

With regard to the embodiments of the protective helmet 10 described above, the person skilled in the art may, in order to satisfy specific requirements, make modifications to and/or replace elements described with equivalent elements, without thereby departing from the scope of the accompanying claims.

The invention claimed is:

1. A protective helmet comprising:

an outer shell;

an impact absorbing liner, positioned inside to the outer shell and shaped so as to correspond to a shape of the wearer's head;

a comfort liner positioned at an inner surface of the impact absorbing liner configured to be in contact with the wearer's head, the comfort liner being attached to one or more of the outer shell and the impact absorbing liner by means of at least one connecting means;

characterized in that the comfort liner is provided with at least one elastic joint which is positioned in proximity of said at least one connecting means for joining the at least one connecting means to the comfort liner, the at least one elastic joint being made of an elastic material;

wherein said at least one connecting means is indirectly connected to said at least one elastic joint and wherein the comfort liner comprises (i) a rigid or semi-rigid front supporting flap connected to a first elastic joint and (ii) a rigid or semi-rigid rear supporting flap connected to a second elastic joint, the at least one connecting means comprises front connecting means and rear connecting means, the front connecting means are provided on the rigid or semi-rigid front supporting flap and the rear connecting means are provided on the rigid or semi-rigid rear supporting flap;

wherein the rigid or semi-rigid front supporting flap is shaped to abut against a front bottom edge of the impact absorbing liner so as to fit with a shape of the front bottom edge of the impact absorbing liner; and wherein the rigid or semi-rigid rear supporting flap is shaped to abut against a rear lower portion of the impact absorbing liner so as to fit with a shape of the rear lower portion of the impact absorbing liner.

2. The protective helmet according to claim 1, characterized in that said at least one elastic joint is interposed between said at least one connecting means and a peripheral portion of the comfort liner.

3. The protective helmet according to claim 1, characterized in that said at least one elastic joint is positioned at a bottom portion of the comfort liner.

4. The protective helmet according to claim 1, characterized in that the comfort liner comprises a crown pad designed to encompass side parts of the wearer's head, and a top pad designed to be positioned on top of the wearer's head.

5. The protective helmet according to claim 4, characterized in that said at least one elastic joint is positioned at a bottom portion of the crown pad, said at least one elastic joint being positioned at a front bottom portion or at a rear bottom portion of the crown pad.

6. The protective helmet according to claim 1, characterized in that the rigid or semi-rigid front supporting flap is designed to be inserted inside a slit provided to front bottom edge of the impact absorbing liner.

7. The protective helmet according to claim 6, characterized in that the front connecting means consist of projections shaped to engage with corresponding cavities provided on the slit.

8. The protective helmet according to claim 1, characterized in that the rear connecting means are provided on a surface of the rigid or semi-rigid rear supporting flap facing the impact absorbing liner.

9. The protective helmet according to claim 8, characterized in that said rear connecting means comprise at least one pin designed to be inserted inside a corresponding seat provided on the impact absorbing liner.

10. The protective helmet according to claim 1, characterized in that said at least one elastic joint is made with polyamide, polyurethane, woven and non-woven fabric.

11. The protective helmet according to claim 1, characterized in that said at least one elastic joint is a strip of elastic material running along the bottom portion of the comfort liner so as to form an appendix.

* * * * *